US010799771B2

(12) United States Patent
Chalifoux

(10) Patent No.: US 10,799,771 B2
(45) Date of Patent: Oct. 13, 2020

(54) RACQUET FLEX CONTROL DEVICE

(71) Applicant: Joseph Jennings, Sarasota, FL (US)

(72) Inventor: Paul R Chalifoux, Naples, FL (US)

(73) Assignee: Joseph Jennings, Sarasota, FL (US)

( * ) Notice: Subject to any disclaimer, the term of this patent is extended or adjusted under 35 U.S.C. 154(b) by 0 days.

(21) Appl. No.: 15/862,793

(22) Filed: Jan. 5, 2018

(65) Prior Publication Data

US 2019/0091521 A1 Mar. 28, 2019

Related U.S. Application Data

(60) Provisional application No. 62/562,397, filed on Sep. 23, 2017.

(51) Int. Cl.
*A63B 49/08* (2015.01)
*A63B 49/03* (2015.01)

(52) U.S. Cl.
CPC ..... *A63B 49/08* (2013.01); *A63B 49/03* (2015.10)

(58) Field of Classification Search
CPC ..... A63B 53/02; A63B 60/26; A63B 60/54; A63B 2060/881; A63B 49/03; A63B 49/08; Y10T 403/45; Y10T 403/451–453; Y10T 403/54; Y10T 403/55; Y10T 403/551; Y10T 403/553
USPC ..... 473/521, 523
See application file for complete search history.

(56) References Cited

U.S. PATENT DOCUMENTS 3,727,956 A * 4/1973 Popeil ..... A47L 11/4075 285/398
3,833,218 A * 9/1974 Frenkel ..... A63B 49/08 473/531
4,367,871 A * 1/1983 Schiefer ..... A63B 49/035 473/463
4,609,198 A * 9/1986 Tarr ..... A63B 49/035 473/523
5,059,057 A * 10/1991 Graef ..... A61F 2/28 403/292
5,236,198 A * 8/1993 Haines ..... A63B 49/02 473/521
5,322,280 A * 6/1994 Wu ..... A63B 49/08 473/523
5,735,752 A * 4/1998 Antonious ..... A63B 53/10 473/317
5,797,613 A * 8/1998 Busby ..... B62K 19/18 267/30

(Continued)

FOREIGN PATENT DOCUMENTS

GB 417010 A * 9/1934 ..... A63B 53/02

*Primary Examiner* — Laura Davison
(74) *Attorney, Agent, or Firm* — Nicholas Pfeifer; Smith & Hopen, P.A.

(57) ABSTRACT

An improved racquet handle, such as for a tennis or racquetball racquet, comprised of a flex control device that enables a user to adjust the flexibility of the racquet handle. The increased flexibility of the racquet handle enables a user to impart greater force on a ball, such as a tennis ball, and also dampens or reduces the amount of vibration and/or shock otherwise imparted to the racquet user when the racquet strikes the ball. The flex control device of the present invention is comprised of a fixed insert portion and an interchangeable, removable insert that enables a user to control the amount of the flexibility of the racquet.

20 Claims, 4 Drawing Sheets

(56) References Cited

U.S. PATENT DOCUMENTS

| | | | | |
|---|---|---|---|---|
| 5,865,694 | A * | 2/1999 | Duong-Van | A63B 60/54<br>473/520 |
| 6,092,823 | A * | 7/2000 | Busby | B62K 19/18<br>267/269 |
| 6,419,601 | B1 * | 7/2002 | Kenner | A63B 49/08<br>473/552 |
| 6,471,607 | B2 * | 10/2002 | Hsu | A63B 49/02<br>473/523 |
| 6,537,164 | B1 * | 3/2003 | Hsu | A63B 60/54<br>473/521 |
| 8,814,731 | B2 | 8/2014 | Jennings | |

* cited by examiner

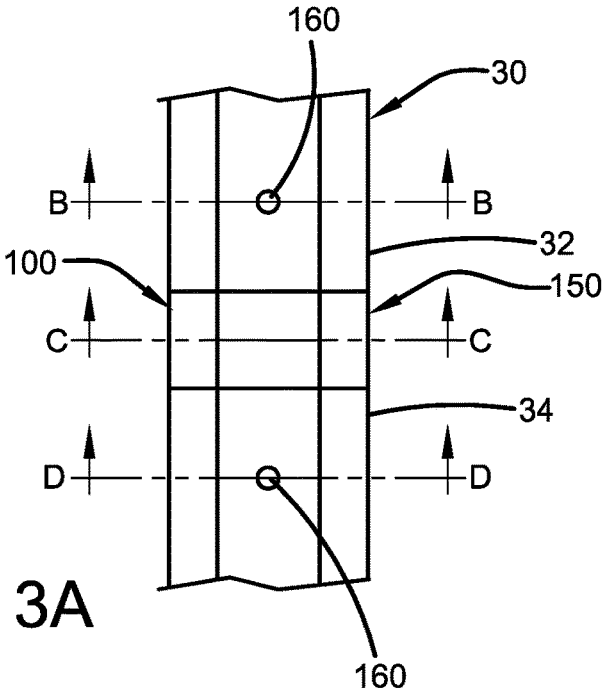
FIG. 3A
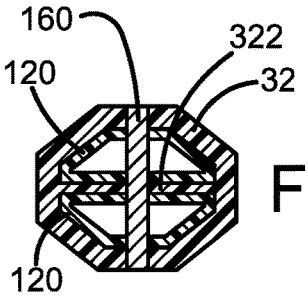
FIG. 3B
FIG. 3C
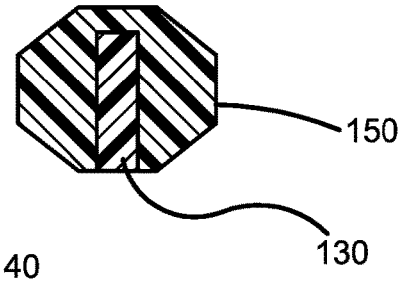
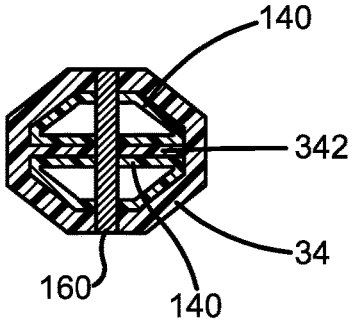
FIG. 3D

RACQUET FLEX CONTROL DEVICE

CROSS-REFERENCE

This application claims priority from Provisional Patent Application Ser. No. 62/562,397 filed on Sep. 23, 2017, which is incorporated herein by reference.

FIELD OF THE INVENTION

This invention relates to an improved racquet handle with a flex control device that improves the flex of the racquet for added power, control and dampening of vibration. More specifically, the device of the present invention enables the user to increase the force imparted on a ball, such as a tennis ball, by the racquet, while reducing the shock to the user resulting from the impact of the racquet striking the ball. The improved racquet handle is comprised of both a fixed insert and an interchangeable, removable insert that permit a user to adjust the amount of flex in the racquet handle to accommodate the various swing speeds and power of different tennis players, or adjust for user injury or fatigue. The improved racquet handle is relatively easy to use, inexpensive to manufacture, and can be used in conjunction with a variety of racquets, such as tennis racquets, racquet ball racquets, badminton racquets and the like.

BACKGROUND

Many individuals enjoy racquet based sports such as tennis, racquetball, badminton and the like. Traditional racquet designs are typically constructed of rigid, hollow or solid handles and posts, which are oftentimes comprised of wood, plastic, fiberglass and the like. More specifically, racquets, such as tennis racquets, are manufactured of relatively light materials so that a user can swing it faster and maneuver it easier. The most common material used to manufacture racquets is carbon fiber reinforced resin. Sheets of carbon fiber are coated with resin and wrapped around a long, narrow balloon to form a long tube that is placed into a mold. The mold is the shape of the desired racquet. The tube end is placed in the handle area of the mold, extended up the handle, around the head portion and back out the handle area. The handle has two tube ends of the material creating a center wall. The mold is closed, the balloon inflated and the material cured. Upon complete cure, the balloon is removed and the resulting racquet is a hollow structure. Holes are then placed to accept strings, and a grip added to the handle.

However, because these prior art designs are relatively rigid, a vibration or shock tends to travel down the racquet handle and to the user when the racquet is used to strike an object such as a ball. Therefore, individuals may not be able to strike the ball very hard, especially if the individual is new to the sport and/or does not possess good form when swinging the racquet. This may be frustrating for the individual, and discourage the individual from continuing with the sport and progressing. Additionally, prolonged exposure of the individual to the shock and/or vibrations generated by existing racquet handle designs could lead to injury, such as stress fractures and the like.

Further, regardless of the experience level or athletic ability of the user, it is advantageous for a user to have a racquet which adds additional speed and/or spin to the ball or projectile being struck by the racquet when desired, which makes it harder for the opponent to successfully return the ball or projectile to the user, thereby providing the improved racquet user with an advantage in the contest.

Consequently, there exists in the art a long-felt need for an improved racquet handle that is relatively flexible and that enables a user to impart greater force and/or spin on a ball, such as a tennis ball, with a racquet, thereby improving the user's play and making the game more enjoyable. More specifically, it would be desirable to create a racquet handle with a point of flex to load force and release it upon impact with its intended target, such as a tennis ball. It would also be desirable to create a racquet handle with a point of flex that is adjustable by use of different removable flex inserts to fit the particular style or ability of the user.

There also exists in the art a long felt need for an improved racquet handle that dampens or reduces the amount of vibration and/or shock otherwise imparted to an individual holding a racquet when the racquet strikes the ball, thereby reducing the likelihood of injury and making the game more enjoyable. Finally, there is a long-felt need for an improved racquet handle that accomplishes all of the forgoing objectives and that is relatively inexpensive to manufacture, and safe and easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, is a flexible racquet design that enables a user to impart greater force on a ball, such as a tennis ball, with the racquet while also dampening or reducing the amount of vibration and/or shock to the individual holding the racquet when the racquet strikes the ball. More specifically, a versatile system, method and series of apparatuses are revealed for creating and utilizing a flex control device placed between sections of a racquet handle to provide more power and reduce vibration when striking a ball, such as a tennis ball.

The racquet of the present invention is produced by sectioning a racquet handle and placing a flex control device between the two sections. Sectioning of the racquet handle preferably occurs in the top half of the grip area—that part closest to the racquet head. The flex control device may be secured inside the racquet handle sections by adhesives, friction fit, interlocking snaps, pins or other common methods of attachment.

The flex control device of the present invention is preferably comprised of a fixed insert and an interchangeable removable insert. The fixed insert is preferably comprised of nylon, plastic, rubber, or other flexible material. The removable insert is attached to the fixed insert, and is also comprised of a flexible material such as nylon, plastic, rubber or other compressive material. When the fixed insert flexes, it engages the removable insert and compresses it thereby allowing the racquet handle to flex.

The foregoing has outlined the more pertinent and important features of the present invention in order that the detailed description of the invention that follows may be better understood, and the present contributions to the art may be more fully appreciated. It is of course not possible to describe every conceivable combination of components and/or methodologies, but one of ordinary skill in the art may recognize that many further combinations or permutations are possible. Accordingly, the novel architecture described below is intended to embrace all such alterations, modifications, and variations that fall within the spirit and scope of the appended claims.

There has thus been outlined, rather broadly, the more important features of the versatile racquet insert system and a series of accompanying systems and apparatuses and embodiments in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

To the accomplishment of the foregoing and related ends, certain illustrative aspects are described herein in connection with the following description and the annexed drawings. These aspects are indicative of the various ways in which the principles disclosed herein can be practice and all aspects and equivalents thereof are intended to be within the scope of the claimed subject matter. Other advantages and novel features will become apparent from the following detailed description when considered in conjunction with the drawings.

BRIEF DESCRIPTION OF THE DRAWINGS

FIG. 3A illustrates a side perspective view of a portion of the flex control device of the present invention installed on a racquet handle in an un-flexed position.

FIG. 3B illustrates a cross-section view of the first end portion of flex control device of FIG. 3A at cut line B-B.

FIG. 3C illustrates a cross-section view of the middle portion and removable insert of flex control device of FIG. 3A at cut line C-C.

FIG. 3D illustrates a cross-section view of the second end portion of flex control device of FIG. 3A at cut line D-D.

Figure 1:
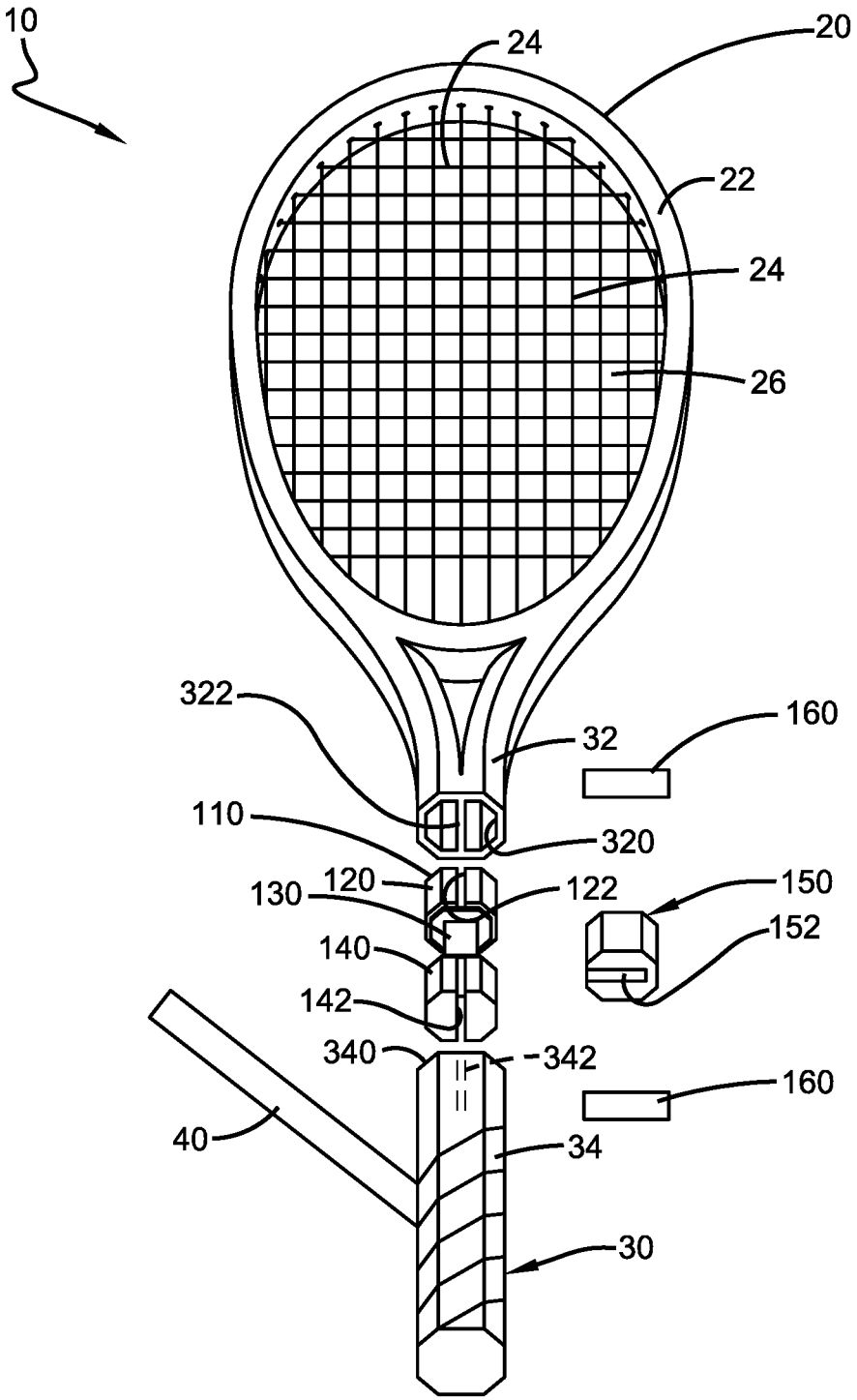
FIG. 1 illustrates a perspective, partially exploded view of one embodiment of the racquet of the present invention.

The above referenced FIGS. are not necessarily to scale, but are offered for illustrative purposes.

DETAILED DESCRIPTION

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details.

Referring initially to the drawings, FIG. 1 illustrates a perspective, partially exploded view of one embodiment of the racquet 10 and flex control device 100 of the present invention. Racquet 10 can be any type of racquet that is known in the art, such as a tennis racquet, racquetball racquet, badminton racquet, etc., and may be comprised of graphite, wood, plastic, fiberglass, metal or other durable material that is well known in the art for manufacturing racquets. Racquet 10 may also come in various shapes, sizes and colors to suit user preference, and may be a solid mass or have a hollowed out opening therein (not shown), as is well known in the art for reducing the weight of the racquet and improving performance.

As best illustrated in FIG. 1, racquet 10 is comprised of a racquet head 20, the flex control device 100 and a handle 30. Racquet head 20 typically comprises a head frame 22 and a plurality of lateral and longitudinal strings 24 strung to span head frame 22 and create interstices or openings 26 framed by said strings 24, as illustrated in FIG. 1. Further, strings 24 are typically under tension to improve the performance of racquet 10, as is well known in the art.

Handle 30 is comprised of an upper handle portion 32 (closest to head 20) and a separate lower handle portion 34 positioned on the opposite side of flex control device 100 from upper handle portion 32. Upper handle portion 32 further comprises a longitudinal opening 320 and a rib 322 positioned therein for mating engagement with flex control device 100, as explained more fully below. Similarly, lower handle portion 34 also comprises a longitudinal opening 340 and a rib 342 positioned therein for mating engagement with an opposite end of flex control device 100, as also explained more fully below.

Figure 2A:
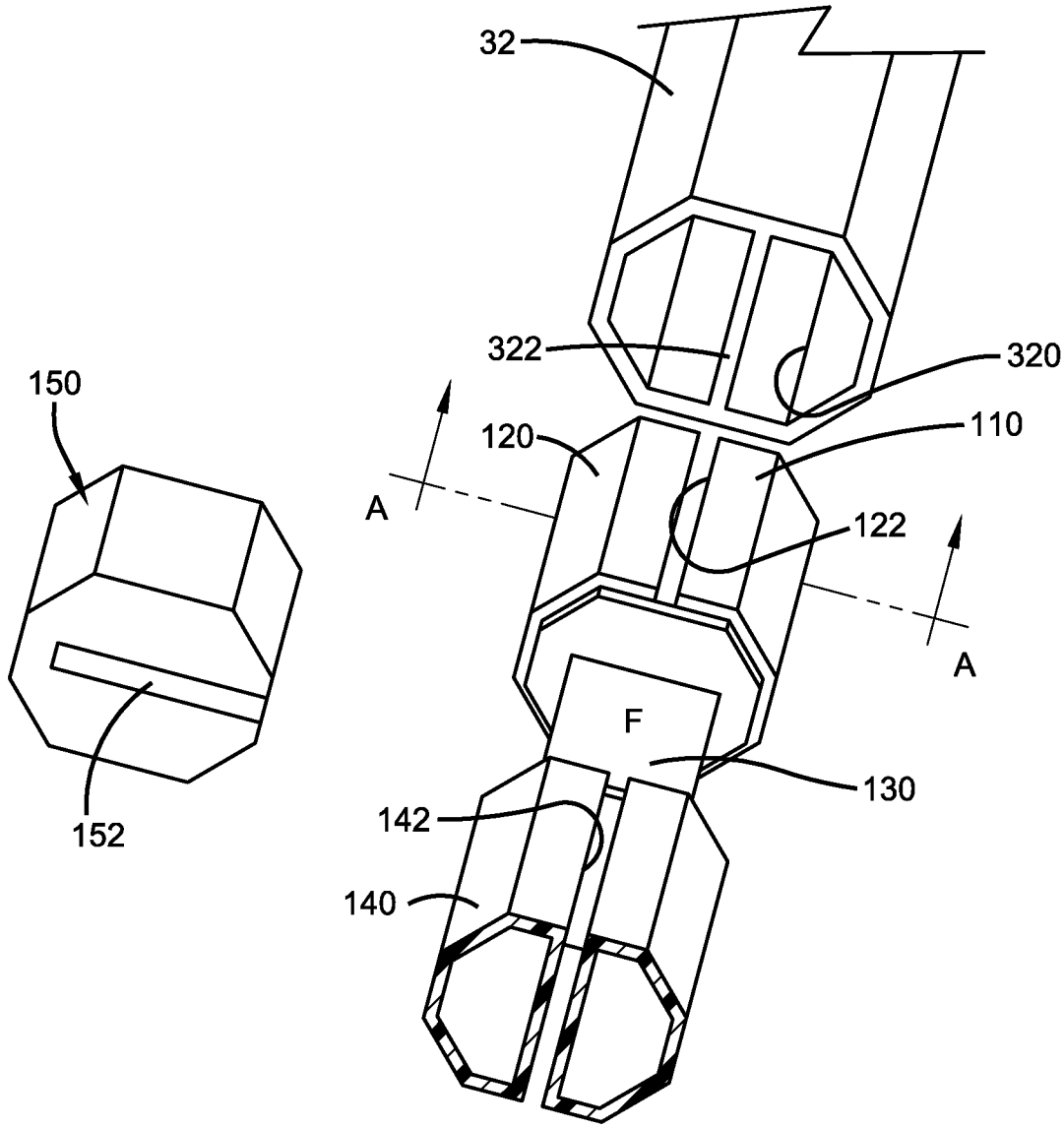
FIG. 2A illustrates a perspective, partially exploded view of a portion of racquet handle and the flex control device of the present invention.
Figure 2B:
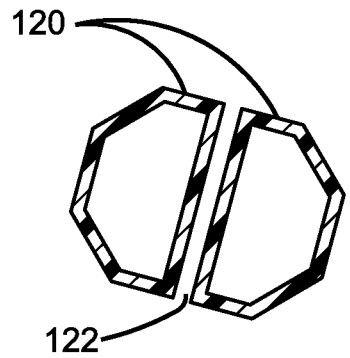
FIG. 2B illustrates a cross-section view of the flex control device of FIG. 2A at cut line A-A.

As best shown in FIG. 1, flex control device 100 is positioned between upper handle portion 32 and lower handle portion 34, and is comprised of a fixed insert 110 and a removable insert 150. Fixed insert 110 is preferably comprised of nylon, polypropylene, plastic, rubber, or other flexible material, and further comprises a first end portion 120 (also referred to as "first insertable body 120"), a middle portion 130 (also referred to as "middle flexible member 130") and a second end portion 140 (also referred to as "second insertable body 140"). As best shown in FIGS. 1, 2A and 2B, first end portion 120 is generally shaped and sized to be matingly inserted into opening 320 in upper handle portion 32 and further comprises a slot 122 for receipt of rib 322 for added stability and secureness. In addition to the potential to be friction fit, first end portion 120 may be further secured to upper handle portion 32 via a pin or other fastener 160 that can be removably inserted through upper handle portion 32, first end 120 and rib 322, or by the use of adhesives or mechanical retention (not shown). First end portion 120 is shown in the Figures to be generally hollow to reduce the overall weight of racquet 10, but one of ordinary skill in the art will appreciate that first end portion 120 may also be solid or filled with a material, such as foam or the like.

Similarly, as best shown in FIGS. 1 and 2A, second end portion 140 is generally shaped and sized to be matingly inserted into opening 340 in lower handle portion 34 and further comprises a slot 142 for receipt of rib 342 for added stability and secureness. In addition to being friction fit, second end portion 140 may be further secured to lower handle portion 34 via a pin 160 that can be removably inserted through lower handle portion 34, second end 140 and rib 342, or by the use of adhesives or other mechanical retention means (not shown). Second end portion 140 is shown in the Figures to be generally hollow to reduce the overall weight of racquet 10, but one of ordinary skill in the art will appreciate that second end portion 140 may also be solid or filled with a material, such as foam or the like.

As best shown in FIGS. 1 and 2A, middle portion 130 is preferably a generally flat, rectangular column positioned between first end portion 120 and second end portion 140, and positioned such that its face F is generally parallel to strings 24. This particular orientation resists twisting of middle portion 130 and allows primary flex in a direction that is generally perpendicular to the face F of middle portion 130.

Middle portion 130 may be integrally formed with first and second end portions 120, 140 or fixedly or removably attached thereto and the respective juncture between middle portion 130 and first and second end portions 120, 140 may be at a right angle or curved or a combination thereof. Importantly, middle portion 130 acts to minimize twisting of the racquet handle and acts like a living hinge when racquet 10 is used to strike an object, such as a tennis ball. Middle portion 130 may also be straight walled, curved or a combination thereof to maximize strength and function.

As best shown in FIGS. 1 and 2A, removable insert 150 is preferably generally C-shaped, with an outer shape and size that is generally consistent with the size and shape of the exterior of upper and lower handle portions 32, 34 so that the overall size and shape of handle 30 is consistent along its length. Nonetheless, as described more fully below, removable insert 150 may take on other embodiments to reduce overall weight of flex control device 100 and racquet 10, or to suit user preference.

Removable insert 150 is preferably comprised of a flexible material such as rubber, polyurethane or silicone, though other flexible materials capable of being partially compressed may also be used. Removable insert 150 further comprises a slot 152 therein for receipt of middle portion 130, and may be attached to fixed insert 110 by any common means known in the art for attaching two articles such as by snaps, friction, an outer grip or other common reversible methods. Once removable insert 150 is removably attached to fixed insert 110, a grip material 40 may be wrapped around handle 30 and device 100 utilizing regular gripping techniques known in the art. Grip material 40 may be comprised of rubber, tape, or other well known material for improving a user's (not shown) grip on racquet 10. To change removable insert 150, grip material 40 may be removed and reapplied.

Importantly, and as further explained below, removable insert 150 is interchangeable, and may be constructed of different durometer materials to provide different flexes to suit user preference. For example, a Shore A 50 material would produce more flex than a Shore A 70 material. Alternatively, less material may be used by placing slots or holes into removable insert 150 which will result in an increase in the amount of flex of racquet 10. As determined by finite element analysis, use of the fixed insert 110 without a removable insert 150 would result in a fracture to device 100, whereas it is believed that utilization of a removable insert 150 constructed of rubber will provide adequate strength for over one million ball strikes. Removable insert 150 may be manufactured using common manufacturing techniques such as injection mold, pour mold, CNC, 3-D printing or other common manufacturing methods.

FIG. 3A illustrates a side perspective view of a portion of the flex control device 100 of the present invention installed on a racquet handle 30 in an un-flexed position and secured by pins 160. FIG. 3B illustrates a cross-section view of first end portion 120 of flex control device 100 at cut line B-B in FIG. 3A, and illustrates first end portion 120 of fixed insert 120 inserted into upper handle portion 32 and secured by pin 160. Fixed insert 120 may also be secured to upper handle portion 32 through the use of friction fit, adhesives, mechanical connections and other means commonly known in the art.

FIG. 3C illustrates a cross-section view of middle portion 130 and removable insert 150 of the flex control device 100 of FIG. 3A at cut line C-C, and FIG. 3D illustrates a cross-section view of second end portion 140 of the flex control device 100 of FIG. 3A at cut line D-D. In FIG. 3D, second end portion 140 of fixed insert 120 is inserted into lower handle portion 34 and secured by pin 160. Fixed insert 120 may also be secured to lower handle portion 34 through the use of friction fit, adhesives, mechanical connections and other means commonly known in the art.

Figure 4A:
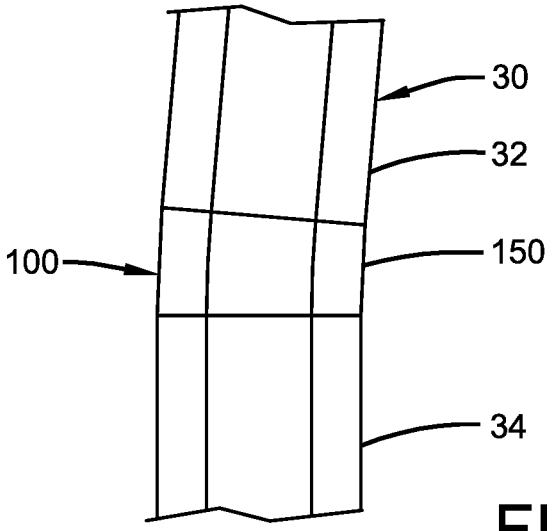
FIG. 4A illustrates a perspective view of a portion of racquet handle and the flex control device of the present invention in a partially flexed position.

FIG. 4A illustrates a perspective view of a portion of racquet handle and the flex control device 100 of the present invention in a partially flexed position, such as when racquet 10 is making contact with an object, such as a tennis ball (not shown). More specifically, flexing of device 100 occurs before and/or at the time of a ball strike. Loaded force is released at ball impact to produce greater force and ball speed. Tennis players swing a tennis racquet at different speeds depending on how strong they are. A stronger player may require less flex than a weaker player for maximum results. As said contact occurs, compression forces are placed onto removable insert 150 and one side of upper handle portion 32 is tipped or flexed in the direction of lower handle portion 34, as best shown in FIG. 4A, and first end portion 120 acts to partially compress removable insert 150 against second end portion 140. By varying the shape, size and composition of removable insert 150, a user can control the amount of flexing that occurs and achieve a desired result.

Figure 4B:
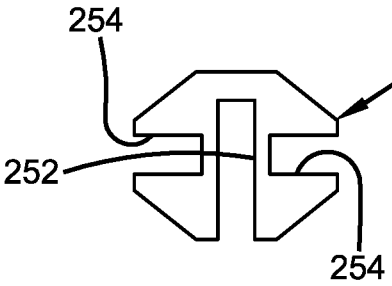
FIG. 4B illustrates a top perspective view of an alternative embodiment of the removable insert of the flex control device of the present invention.

FIG. 4B illustrates a top perspective view of an alternative embodiment of a removable insert 250 of the flex control device 100 of the present invention. In this particular embodiment, removable insert 250 is comprised of a slot 252 for receipt of middle portion 130, and additional openings 254 to reduce the overall weight and increase the overall flexibility of device 100.

Figure 4C:
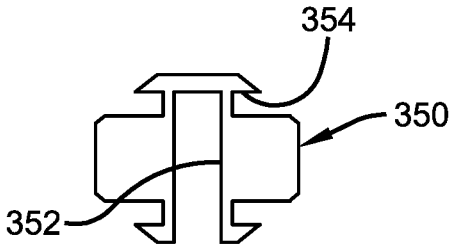
FIG. 4C illustrates a top perspective view of yet another alternative embodiment of the removable insert of the flex control device of the present invention.

FIG. 4C illustrates a top perspective view of yet another alternative embodiment of a removable insert 350 of the flex control device 100 of the present invention. In this particular embodiment, removable insert 350 is comprised of a slot 352 for receipt of middle portion 130, and additional openings 354 to reduce the overall weight and increase the overall flexibility of device 100.

Figure 4D:
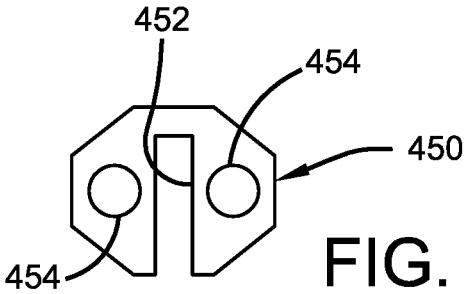
FIG. 4D illustrates a top perspective view of yet another alternative embodiment of the removable insert of the flex control device of the present invention.

FIG. 4D illustrates a top perspective view of yet another alternative embodiment of a removable insert 450 of the flex control device 100 of the present invention. In this particular embodiment, removable insert 450 is comprised of a slot 452 for receipt of middle portion 130, and additional openings 454 to reduce the overall weight and increase the overall flexibility of device 100.

Removable inserts 150, 250, 350 and 450 can be manufactured with different degrees of flexibility to suit user need and/or preference. In this manner, as a user progresses in his or her development as a player, the user can increase or decrease the flexibility of his or her racquet handle by using removable inserts with different degrees of flexibility with the same racquet handle, as opposed to having to purchase a new racquet and/or handle each time the user desires to make a change to the flexibility of the racquet handle. Further, as noted above, in a preferred embodiment of the present invention, the size and cross-sectional shape of device 100 should complement the general size and cross-sectional shape of handle 30 so as to not interfere with the user's grip on handle 30.

Consequently, improved racquet 10 includes a racquet handle that is relatively flexible and that enables a user to impart greater force on a ball, such as a tennis ball, thereby improving the user's play and making the game more enjoyable. The improved racquet handle and flex point(s) located thereon also dampens or reduces the amount of vibration and/or shock otherwise imparted to an individual holding a racquet when the racquet strikes the ball, thereby reducing the likelihood of injury and making the game more enjoyable. Additionally, the structure of the improved racquet handle and device 100 permit the user to use the improved racquet handle with a plurality of interchangeable racquet heads, thereby sparing the user the expense and storage requirements associated with owning multiple racquets. Finally, the improved racquet is relatively inexpensive to manufacture, and safe and easy to use.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A racquet flex control device, comprising:

a fixed insert and a removable insert, wherein the fixed insert and the removable insert are configured to reside at least partially between an upper racquet handle portion and a lower racquet handle portion;

the fixed insert having:

a first insertable body, a second insertable body, and a central longitudinal axis extending between the first and second insertable bodies;

the first insertable body having a size and shape to be received within an opening in a frame of the upper racquet handle portion;

the second insertable body having a size and shape to be received within an opening in a frame of the lower racquet handle portion;

a middle flexible member having a first end attached to the first insertable body, a second end attached to a second insertable body, and an extent spanning between the first insertable body and the second insertable body, such that the first insertable body and the second insertable body are longitudinally spaced from each other;

the middle flexible member of the fixed insert having a cross-sectional area smaller in size than each cross-sectional area of the first and second insertable bodies;

the middle flexible member extending between the upper racquet handle portion and the lower racquet handle portion when the first insertable body and second insertable body are secured within the upper racquet handle portion and the lower racquet handle portion, respectively, such that the upper racquet handle portion and the lower racquet handle portion are longitudinally spaced from each other;

whereby the smaller cross-sectional area of the middle flexible member and the spacing between the upper racquet handle portion and the lower racquet handle portion result in an increase in flexion of the middle flexible member in comparison to other sections of the fixed insert;

the removable insert further including:

a body with a length extending in a longitudinal direction, the length being substantially equal to the longitudinal spacing between the first insertable body and the second insertable body;

a slot disposed in a lateral side wall of the body, the slot sized and shaped to laterally receive the middle flexible member of the fixed insert; and wherein the removable insert is longitudinally compressible, such that the removable insert can be compressed when the middle flexible member of the fixed insert flexes.

2. The racquet flex control device of claim 1, further comprising a longitudinally extending slot disposed within a free surface of the first insertable body of the fixed insert, the slot spanning between two opposing lateral sides of the first insertable body to receive a structural rib within the upper racquet handle portion when the first insertable body is secured within the upper racquet handle portion.

3. The racquet flex control device of claim 1, further comprising a longitudinally extending slot disposed within a free surface of the second insertable body of the fixed insert, the slot spanning between two opposing lateral sides of the second insertable body to receive a structural rib within the lower racquet handle portion when the second insertable body is secured within the lower racquet handle portion.

4. The racquet flex control device of claim 1, wherein the middle flexible member is a flat rectangular body.

5. The racquet flex control device of claim 4, wherein the flat rectangular body of the middle flexible member is substantially parallel with a set of strings on the upper racquet handle portion when the first insertable body is secured within the upper racquet handle portion.

6. The racquet flex control device of claim 4, wherein the flat rectangular body of the middle flexible member is substantially axially aligned with the central longitudinal axis of the fixed insert.

7. The racquet flex control device of claim 1, wherein the removable insert has a cross-sectional outer perimeter that is substantially equivalent to a cross-sectional outer perimeter of the lower racquet handle portion when the racquet flex control device is secured to the lower racquet handle portion.

8. The racquet flex control device of claim 1, wherein a portion of the removable insert is in compression when the middle flexible member of the fixed insert is flexed.

9. A racquet flex control device, comprising:

a fixed insert and a removable insert, wherein the removable insert is configured to reside between an upper racquet handle portion and a lower racquet handle portion;

the fixed insert having:

a first insertable body, a second insertable body, and a central longitudinal axis extending between the first and second insertable bodies;

the first insertable body having a size and shape to be received within an opening in a frame of the upper racquet handle portion;

the second insertable body having a size and shape to be received within an opening in a frame of the lower racquet handle portion;

a middle flexible member extending between an inwardly facing surface of the first insertable body and an inwardly facing surface of the second insertable body, such that the first insertable body is longitudinally spaced from the second insertable body, wherein the inwardly facing surfaces of the first and second insertable bodies are generally perpendicular to the central longitudinal axis and facing each other;

the middle flexible member of the fixed insert having a cross-sectional area smaller in size than a cross-sectional area of the first insertable body and a cross-sectional area of the second insertable body;

the middle flexible member extending between the upper racquet handle portion and the lower racquet handle portion when the first insertable body and second insertable body are secured within the upper racquet handle portion and the lower racquet handle portion, respectively, such that the upper racquet handle portion and the lower racquet handle portion are longitudinally spaced from each other;

the removable insert further including:

a body with a length extending in a longitudinal direction, the length being substantially equal to the extent of the middle flexible member;

wherein the removable insert is configured to connect and disconnect from the fixed insert while the first and second insertable bodies of the fixed insert are secured to the upper racquet handle portion and the lower racquet handle portion, respectively; and wherein the removable insert is longitudinally compressible, such that the removable insert can be compressed when the middle flexible member of the fixed insert flexes.

10. The racquet flex control device of claim 9, further comprising a slot disposed in a lateral side wall of the body of the removable insert, the slot sized and shaped to laterally receive the middle flexible member of the fixed insert.

11. The racquet flex control device of claim 9, further comprising a longitudinally extending slot disposed within a free surface of the first insertable body of the fixed insert, the slot spanning through two opposing lateral sides to receive a structural rib within the upper racquet handle portion when the first insertable body is secured within the upper racquet handle portion.

12. The racquet flex control device of claim 9, further comprising a longitudinally extending slot disposed within a free surface of the second insertable body of the fixed insert, the slot spanning through two opposing lateral sides of the second insertable body to receive a structural rib within the lower racquet handle portion when the second insertable body is secured within the lower racquet handle portion.

13. The racquet flex control device of claim 9, wherein the middle flexible member is a flat rectangular body.

14. The racquet flex control device of claim 13, wherein the flat rectangular body of the middle flexible member is substantially parallel with a set of strings on the upper racquet handle portion when the first insertable body is secured within the upper racquet handle portion.

15. The racquet flex control device of claim 13, wherein the flat rectangular body of the middle flexible member is substantially axially aligned with the central longitudinal axis of the fixed insert.

16. The racquet flex control device of claim 9, wherein the removable insert has a cross-sectional outer perimeter that is substantially equivalent to a cross-sectional outer perimeter of the lower racquet handle portion when the racquet flex control device is secured to the lower racquet handle portion.

17. The racquet flex control device of claim 9, wherein a portion of the removable insert is in compression when the middle flexible member of the fixed insert is flexed.

18. A racquet flex control device, comprising:

a fixed insert and a removable insert, wherein the removable insert is configured to reside between an upper racquet handle portion and a lower racquet handle portion;

the fixed insert having:

a first insertable body, a second insertable body, and a central longitudinal axis extending between the first and second insertable bodies;

the first insertable body having a size and shape to be received within an opening in a frame of the upper racquet handle portion;

the second insertable body having a size and shape to be received within an opening in a frame of the lower racquet handle portion;

a middle flexible member extending between the first insertable body and the second insertable body, such that the first insertable body is longitudinally spaced from the second insertable body;

the middle flexible member having a cross-sectional area smaller in size than both a cross-sectional area of the first insertable body and a cross-sectional area of the second insertable body;

the middle flexible member extending between the upper racquet handle portion and the lower racquet handle portion when the first insertable body and second insertable body are secured within the upper racquet handle portion and the lower racquet handle portion, respectively, such that the upper racquet handle portion and the lower racquet handle portion are longitudinally spaced from each other;

the removable insert further including:

a body with a length extending in a longitudinal direction, the length being equal to the extent of the middle flexible member;

wherein the removable insert is configured to connect and disconnect from the fixed insert while the first and second insertable bodies of the fixed insert are secured to the upper racquet handle portion and the lower racquet handle portion, respectively; and wherein the removable insert is longitudinally compressible, such that the removable insert can be compressed when the middle flexible member of the fixed insert flexes.

19. The racquet flex control device of claim 18, further comprising:

a longitudinally extending slot disposed within a free surface of the first insertable body of the fixed insert, the slot spanning through two opposing lateral sides of the first insertable body to receive a structural rib within the upper racquet handle portion when the first insertable body is secured within the upper racquet handle portion; and a longitudinally extending slot disposed within a free surface of the second insertable body of the fixed insert, the slot spanning through two opposing lateral sides of the second insertable body to receive a structural rib within the lower racquet handle portion when the second insertable body is secured within the lower racquet handle portion.

20. The racquet flex control device of claim 18, further comprising a slot disposed in a lateral side wall of the body of the removable insert, the slot sized and shaped to laterally receive the middle flexible member of the fixed insert, such that the removable insert can be connected and disconnected from the fixed insert while the first and second insertable bodies of the fixed insert are secured to the upper racquet handle portion and the lower racquet handle portion, respectively.

* * * * *